United States Patent [19]

Takakura et al.

[11] Patent Number: 4,613,093

[45] Date of Patent: Sep. 23, 1986

[54] APPARATUS FOR LOOPING BELT-LIKE MATERIALS

[75] Inventors: Yoshio Takakura, Hitachi; Ryo Abo, Toukai; Isamu Ishiyama; Toshiyuki Kajiwara, both of Hitachi; Tetsuya Higuchi, Katsuta; Teruo Yamaguchi; Hiromitsu Mitsui, both of Hitachi; Yoshihisa Furuzono, Aikawa; Shunichi Hamada, Toyonaka, all of Japan

[73] Assignee: Hitachi, Ltd., Tokyo, Japan

[21] Appl. No.: 804,609

[22] Filed: Dec. 4, 1985

Related U.S. Application Data

[63] Continuation of Ser. No. 577,818, Feb. 7, 1984, abandoned.

[30] Foreign Application Priority Data

Feb. 9, 1983 [JP] Japan ..... 58-18800

[51] Int. Cl.[4] ..... B65H 20/24; B65H 20/26

[52] U.S. Cl. ..... 242/55; 242/55.19 R; 242/78.1

[58] Field of Search ..... 242/55, 55.16, 55.19 R, 242/55.21, 75.2, 78.1, 78.7

[56] References Cited

U.S. PATENT DOCUMENTS

| | | | |
|---|---|---|---|
| 3,310,255 | 3/1967 | Sendzimir | 242/78.1 |
| 3,506,210 | 4/1970 | Latour et al. | 242/55 |
| 3,685,711 | 8/1972 | Gay | 242/75.2 X |
| 3,782,662 | 1/1974 | Miller | 242/78.1 X |
| 4,012,005 | 3/1977 | Hattersley, Jr. | 242/55 |
| 4,163,527 | 8/1979 | Hood et al. | 242/55 |
| 4,288,042 | 9/1981 | Sendzimir | 242/55 |
| 4,497,452 | 2/1985 | Sendzimir | 242/78.1 X |
| 4,505,438 | 3/1985 | Sendzimir et al. | 242/55 |

*Primary Examiner*—John Petrakes

*Attorney, Agent, or Firm*—Antonelli, Terry & Wands

[57] ABSTRACT

An apparatus for looping belt-like materials, including first and second looping units for winding a moving belt-like material helically into first and second coils, with a portion of the belt-like material forming the first coil being drawn out into the second coil. A plurality of support rollers annularly arranged along each of the portions of the wound belt-like material forming the first and second coils, and frames are provided with the support rollers, along with a drive for applying a rotary force to the frames. The support rollers are displaceable in a radial direction of an imaginary circle along which the support rollers are arranged in accordance with variations in diameters of the coils so as to bring the support rollers into contact with the portions of the belt-like material which constitute the coils. The support rollers are annularly arranged along inner circumferential surfaces of the coils, with the drawing of the portion of the first coil being effected by a plurality of small-diameter rollers, arranged along a curved surface of an imaginary cone or cylinder in such a manner that the small-diameter rollers can be rotated in the direction in which the belt-like material is drawn out.

4 Claims, 12 Drawing Figures

APPARATUS FOR LOOPING BELT-LIKE MATERIALS

This is a continuation of application Ser. No. 577,818, filed Feb. 7, 1984 and now abandoned.

BACKGROUND OF THE INVENTION

This invention relates to a looping apparatus capable of accumulating and paying out belt-like materials such as, for example, strips independently of a proceeding or subsequent processing step.

In order to continuously process a belt-like material to, for example, plate a soft steel strip, it is necessary that a means for temporarily storing the belt-like material be provided.

In general, in a so-called "looper" is employed, a storing means a belt-like material constituting a subsequent coil can be payed out while a belt-like material already payed out is temporarily stored in the storage means, to join by welding a front end of newly played out, belt-like material stored to a rear end of the stored belt-like material thereby enabling the belt-like materials to be continuously supplied to a processing machine in a subsequent step. A looper of a looping tower system, which is moved on a vertical frame, and a looper of a looping car system, which runs on horizontal rails, are widely used.

In, for example, U.S. Pat. No. 3,310,255, a spiral looper is proposed which is capable of storing a large quantity of a belt-like material, hereinafter referred to as a strip in a comparatively small space. In this proposed looping apparatus, a strip is vertically on a spiral looper, i.e. a strip supplied in a horizontal direction is twisted and put in a vertically extending state by a guide roller to be sent to a spiral looper. Thus, it is necessary that a strip in a horizontally extending state be twisted in a vertically extending state in a section including positions on the front and rear sides of the spiral looper. A disadvantage of this proposed looper resides in the fact that, due to the strip-twisting section, it is necessary to provide a comparatively large area which extends in longitudinal direction of a strip, thereby increasing the dimensions of a looping apparatus.

In such an apparatus, a strip is moved as it is wound in a plurality of layers, i.e. into a coil on an upper table or a lower table in a spiral looper, and a moving speed of the strip wound into a coil, i.e. a speed v of the portion of the strip which is halfway between upper and lower surfaces thereof does not vary in different points on the coil, for example, in points on inner and outer layers thereof. Accordingly, as shown in FIG. 1, which shows outer and inner strips 1, 1' contacting each other at their surfaces 1*a*, 1*a'*, a moving speed v' at the contact surface 1*a* of the outer strip 1 and a moving speed v'' at the contact surface 1*a'* of the inner strip 1' can be expressed by the following equations:

$$V' = v\left(1 - \frac{h}{2R}\right)$$

$$V'' = v\left(1 + \frac{h}{2R}\right)$$

where:

v equals a moving speed at a portion of a strip which is halfway between the upper and lower surfaces thereof;

h equals the thickness of a strip; and

R is a radius of the coil between the center thereof and the contact surfaces of the strips.

Therefore, a speed difference $\Delta V = V'' - V' = vh/R$ necessarily occurs on the contact surfaces 1*a*, 1*a'* of the strips 1, 1'. This necessarily causes slipping between the strips 1, 1', so that it is impossible to prevent the strips 1, 1' from being damaged. For these reasons, it is difficult to apply such a looping apparatus to cold-rolled strips, zinc-plated strips and color steel plates, which strictly require a high quality of surface.

An object of the present invention is to provide an apparatus for looping belt-like materials which presents an occurrence of slipping between layers of a strip wound into a coil, while the strip is moved.

In accordance with present invention, an apparatus for looping belt-like materials is proposed which includes first and second looping units for winding a moving strip, i.e. a moving belt-like material helically into first and second coils, a means for drawing out the portion of the belt-like material forming the first coil, into the second coil, with a plurality of support rollers being arranged annularly along each of the portions of the wound belt-like material which constitute the first and second coils. Frames are provided with the annularly arranged support rollers, and driving means apply the rotary force to the frames. Means are provided for displacing the support rollers in a radial direction of an imaginary circle, along which the rollers are arranged, in accordance with variations in the diameters of the coils so as to bring the support rollers into contact with the portions of the belt-like material which constitute the coils.

DETAILED DESCRIPTION

Figure 1:
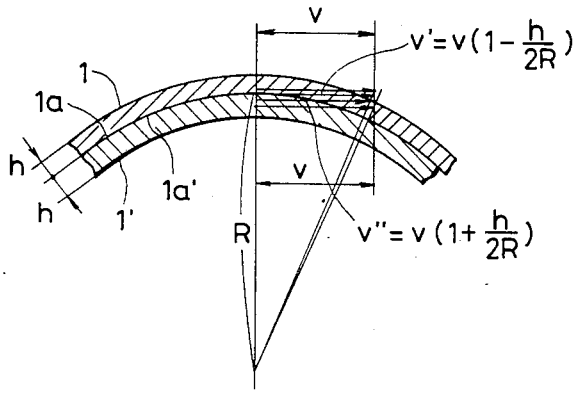
FIG. 1 PRIOR ART
FIG. 1 is a partial cross-sectional view depicting moving speeds of layers of a strip on an upper or lower table in a conventional spiral looper.
Figure 2:
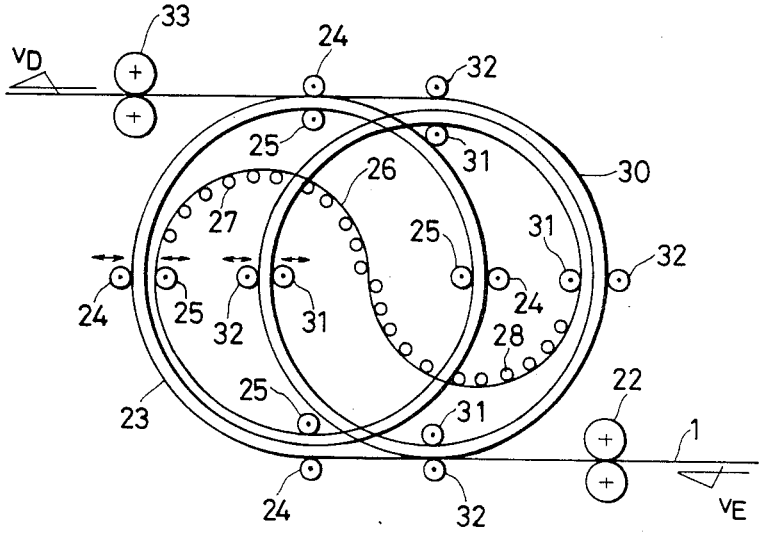
FIG. 2 is a partially schematic view of a strip in a looping apparatus according to the present invention with input and output coils drawn in a staggered state.
Figure 3:
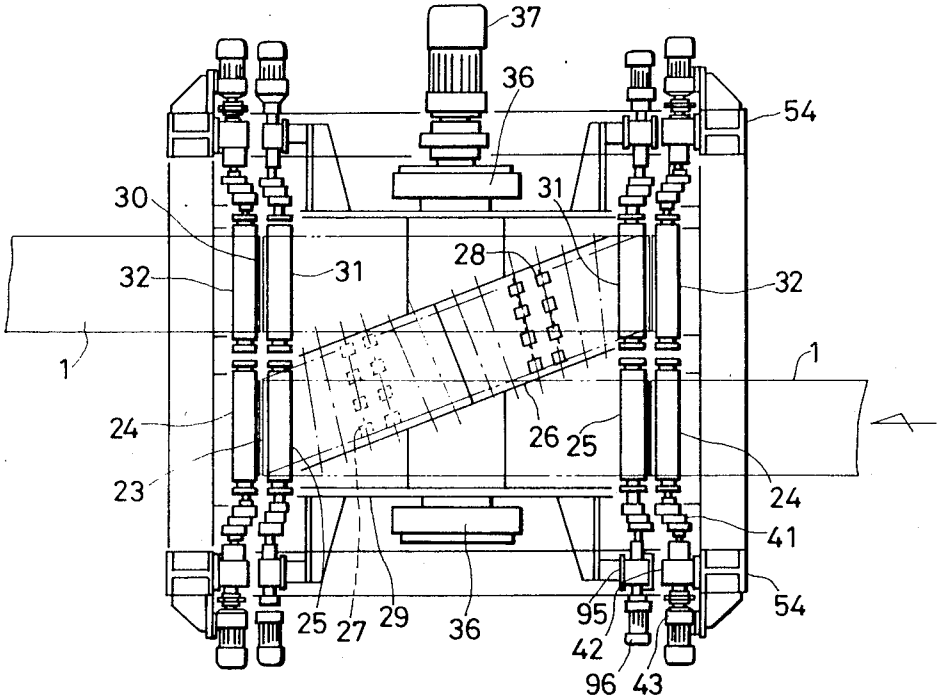
FIG. 3 is a plan view of a detail of a construction of an embodiment of the looping apparatus according to the present invention.

An embodiment of a strip looping apparatus according to the present invention will now be described with reference to the drawings.

Referring now to the drawings wherein like referencee numerals are used throughout the various views to designate like parts and, more particularly, to FIGS. 2–8, according to these figures, a strip 1 is supplied to an inlet of a looping apparatus via inlet pinch rollers 22 to be wound in a plurality of layers and form an inlet coil 23, with a plurality of support rollers 24 being arranged annularly along an outer surface of the inlet coil 23, and a plurality of support rollers 25 arranged along an inner surface thereof, and with the coil 23 being supported on the rollers 24, 25.

Figure 4:
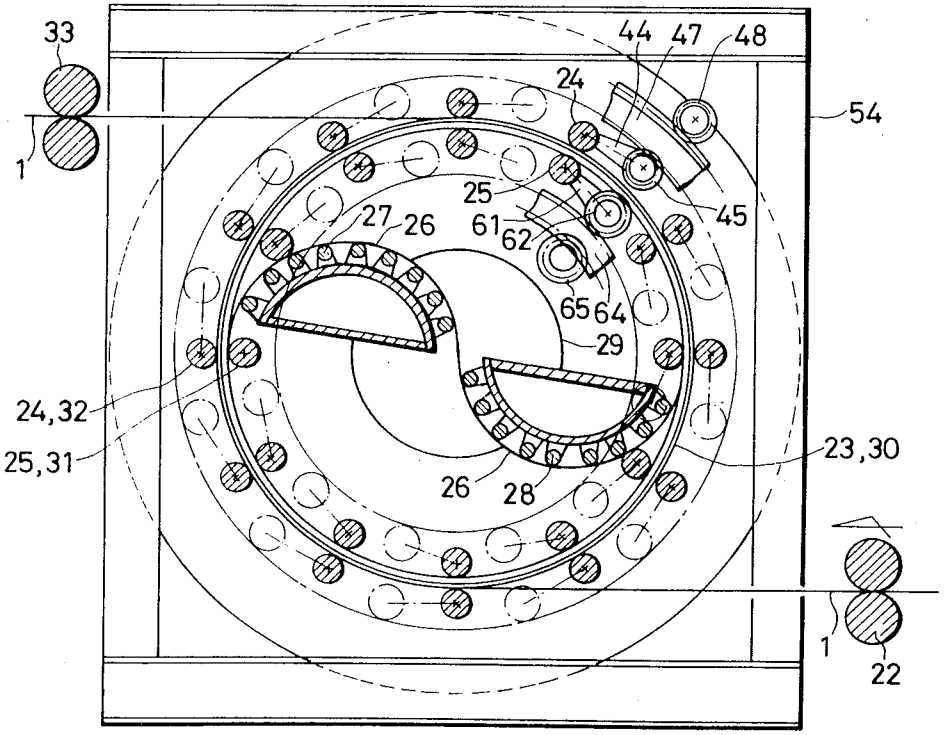
FIG. 4 is a front elevational cross-sectional view section of the looping apparatus of FIG. 3, taken in an advance direction of a strip.
Figure 5:
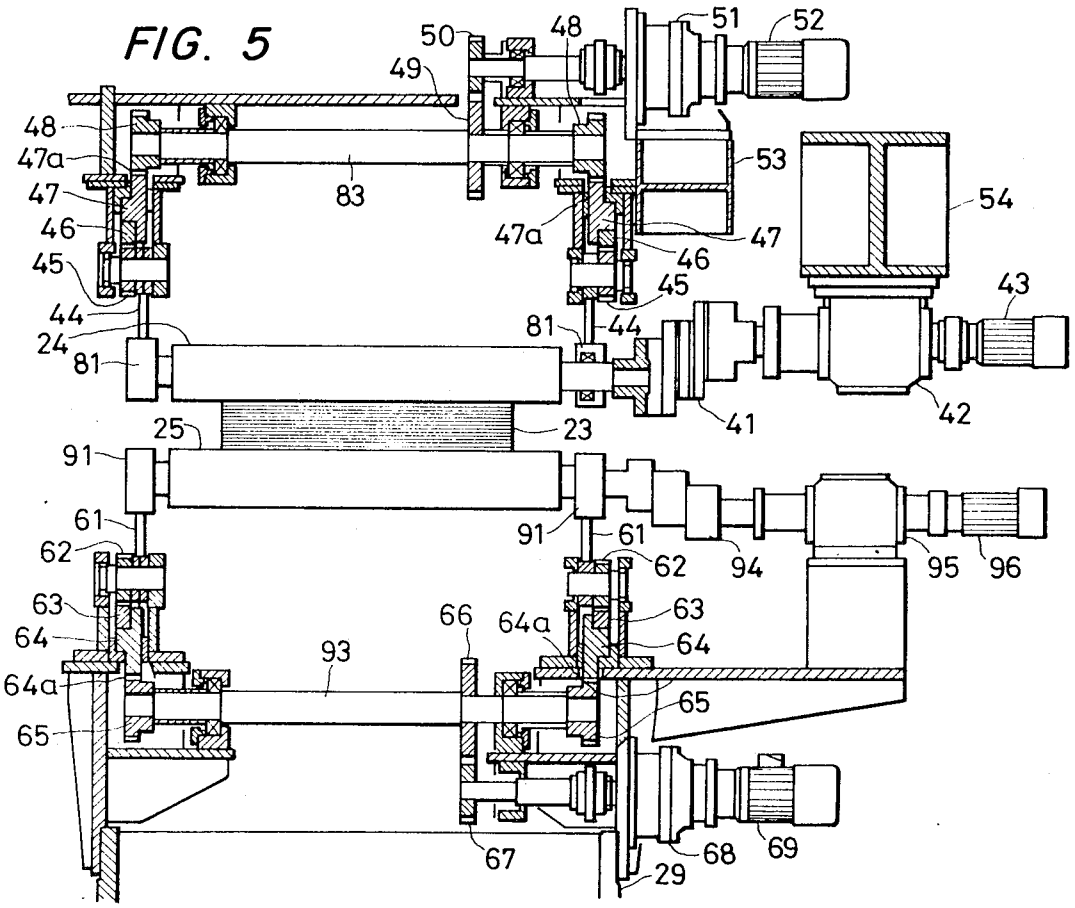
FIGS. 5 and 6 are cross-sectional views of a mechanism for radially displacing support rollers arranged on the outer and inner sides of coils formed in the looping apparatus shown in FIG. 3.
Figure 6:
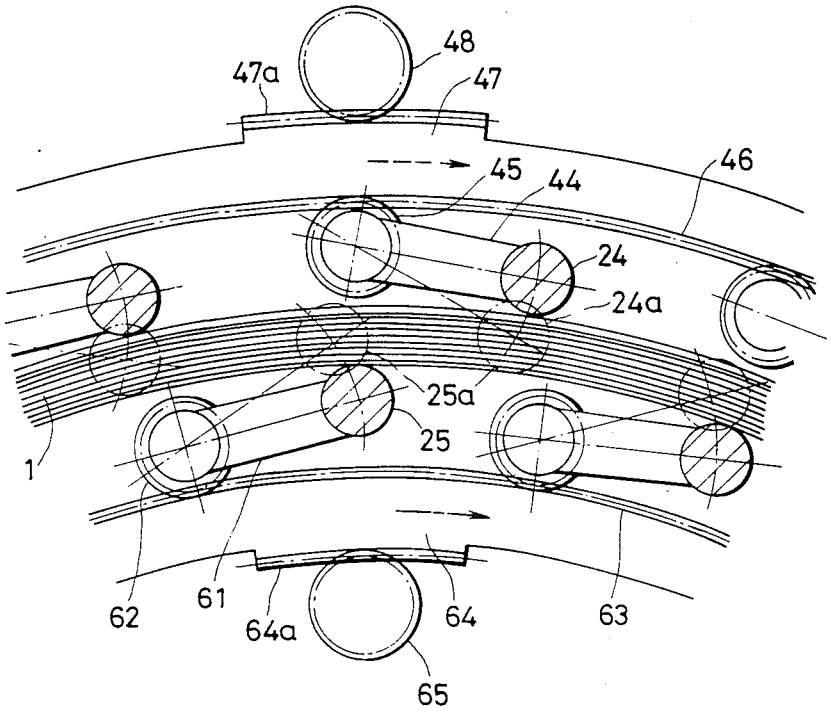

The portion of the strip exiting the inlet coil 23 is moved to an outlet coil 30 through a helical turning section 26, forming a drawing means, so as to be incorporated into the coil 30 and stored. A plurality of support rollers 32 are arranged annularly along an outer surface of the outlet coil 30, with the plurality of support rollers 31 being arranged annularly along an inner surface of the outlet coil 30 so that the coil 30 is supported on the support rollers 32, 31. The portion of the strip which has passed the outlet coil 30 is supplied to the outside of the looping apparatus through pinch rollers 33. As shown most clearly in FIGS. 3–5, in the inlet coil 23, the outer support rollers 24 are rotated by a motor 43 through a coupling 41 and a distributing gear 42. In each of the outer support rollers 24, bearing cases 81 supporting journal portions thereof are engaged with gears 45 through arms 44 as shown in FIGS. 4–6, and the gears 45 mesh with outer pivotal members 47 having gears 46 on their respective inner circumferential surfaces. Thus, the position of each support roller 24 in its radial direction can be regulated in such a manner that the support roller 24 contacts an outer circumferential surface of a coil. The outer pivotal members 47 are also provided on their outer circumferential surfaces with gears 47*a*, which are meshed with gears 48 mounted on end portions of a shaft 83. The shaft 83 is engaged through a gear 49, mounted on an intermediate portion thereof, with a reducing gear 51 and a gear 50, which are connected to a motor 52. The motor 52 is rotated to move the outer pivotal members 47 in the circumferential direction and turn, through the gears 46, 45, the arms 44 around the gears 45. Thus, an amount of radial displacement of each support roller 24 is regulated. The driving means for the outer support rollers 24 is secured to a frame 54.

Figure 7:
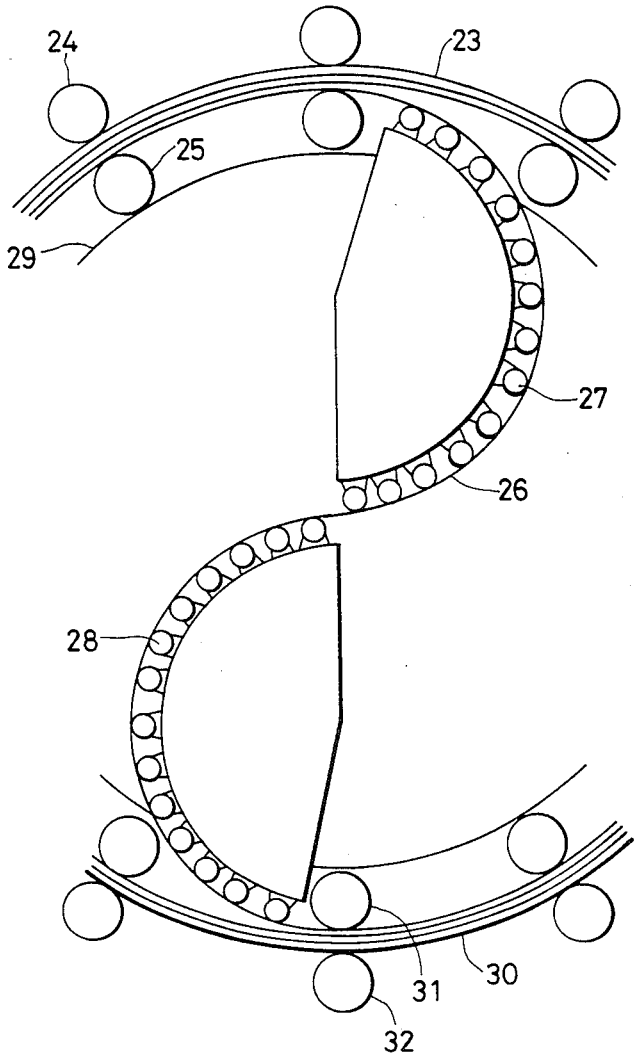
FIG. 7 is a fragmentary sectional view illustrating the condition of a helically turning section of the looping apparatus shown in FIG. 3.
Figure 8:
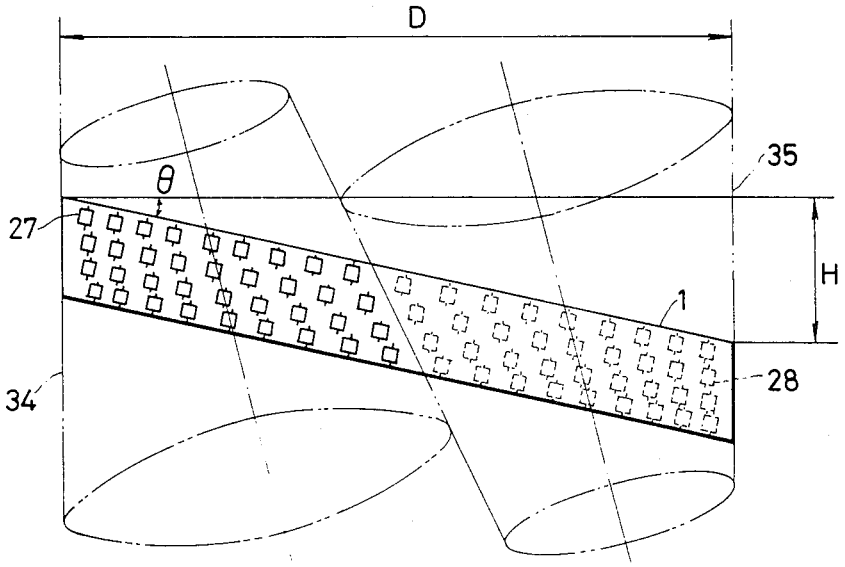
FIG. 8 is a schematic side elevational view of small-diameter rollers provided in the helically turning section of FIG. 7.

Each of the inner support rollers 25 is also rotated by a motor 96 through a coupling 94 and a distributing gear 95. Bearing cases 91 supporting journal portions of each inner support roller 25 are engaged with gears 62 through arms 61, and the gears 62 are meshed with inner pivotal members 64 having gears 63 on their respective outer circumferential surfaces. Thus, the position of each support roller 25 in its radial direction can be regulated in such a manner that the support roller 25 contacts the inner circumferential surface of a coil. The inner pivotable members 64 are also provided on their respective inner circumferential surfaces with gears 64*a*, which mesh with gears 65 mounted on end portions of a shaft 93. The shaft 93 is engaged through a gear 66, mounted on an intermediate portion thereof, with a reducing gear 68 and a gear 67 connected to a motor 69. The motor 69 is rotated to move the inner pivotal members 64 in the circumferential direction and turn, through the gears 63, 62, the arms 61 around the gears 62. Thus, an amount of radial displacement of each support roller 25 is regulated. The inner support rollers 25 and the above-mentioned driving means are secured to a rotary frame 29. The inner support rollers 25 and driving means therefor are adapted to be rotated with the rotary frame 29. Bearings 36 of the rotary frame 29 are connected to a driving means in the form of a motor 37. The rotary force is applied from the motor 37 in a predetermined direction (the direction in which a strip is supplied) at all times to the rotary frame 29 to apply tension to the portions of a strip, at the helical turning section 26. The portion of the strip 1 which comes out of the inlet coil 23 is moved to the outlet coil 30 through the helical turning section 26. As shown in FIGS. 7 and 8 the helical turning section 26 includes a plurality of free, small-diameter rollers 27, 28 fixedly arranged along outer circumferential surfaces of intermediate portions of imaginary cones 34, 35. The free rollers 27, 28 are so that the rotational direction of outer circumferential surfaces thereof agree with the direction, in which the strip 1 advances. Accordingly, the strip 1 is moved from the inlet coil 23 to the outlet coil 30 as it is wound around the imaginary cones 34, 35. As apparent from FIG. 8, illustrating a helical turning section 26 using imaginary cones, helical turning section formed by arranging the free rollers 27, 28 along intermediate portions of cylinders does not differ in function from the helical turning section 26 described above. In FIG. 8 has a diameter the looper D. The helical turning section 26 is fixed to the rotary frame 29, which is driven so as to receive the rotary force from the motor 37 through the bearings 36.

The outlet coil 30 is supported in the same manner as the inlet coil 23, on the support rollers 31, 32 disposed on the inner and outer surfaces of the coil 30, so that the coil 30 can be kept firm. The support rollers 31, 32 have the same construction as the support rollers 24, 25 for the inlet coil 23, and are adapted to be moved in accordance with variations in the diameter of the outlet coil 30. The portion of the strip 1 which comes out of the outlet coil 30 passes the outlet pinch rollers 33 to advance to the outside of the looper.

Figure 9:
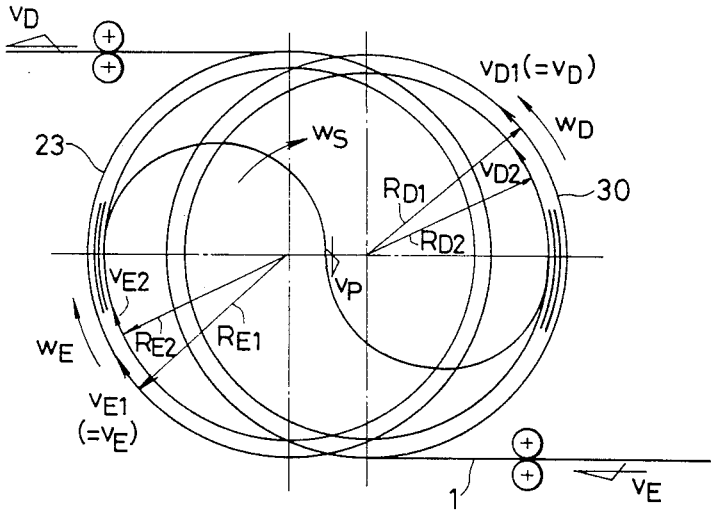
FIG. 9 is a schematic view depicting the function of the looping apparatus according to the present invention.

The looping function or function of accumulating a strip in a wound state of the looping apparatus of is best understood from a review of FIG. 9. The length $\Delta L$ of a strip 1 accumulated in a looper within the time $\Delta t$ can be expressed by the following equation:

$$\Delta L=(V_E-V_D)\Delta t \quad (1)$$

When a speed $V_E$ of a strip at an inlet of a looper is less than a speed $V_D$ thereof at an outlet thereof, a value of $\Delta L$ in the above equation becomes negative meaning that the strip 1 is payed out. In order to accumulate a strip of a length $\Delta L$ in a looper, the rotary frame 29 is turned at an angular speed $\omega s$, which is expressed by the following equation:

$$s = \frac{1}{R_{E2} + R_{D2}}\left(\frac{R_{E2}}{R_{E1}} V_E - \frac{R_{D2}}{R_{D1}} V_D\right) \quad (2)$$

where:

$R_{E1}$ = an outer diameter of the outermost layer of an inlet coil;

$R_{E2}$ an inner diameter of the innermost layer of the inlet coil;

$R_{D1}$ = an outer diameter of the outermost layer of the outlet coil; and $R_{D2}$ = an inner diameter of the innermost layer of an outlet coil.

It is considered that, in equation (2), $R_{E1} \approx R_{E2}$; and $R_{D1} \approx R_{D2}$; therefore, the following equation can be established:

$$\omega s = \frac{1}{R_{E2} + R_{D2}} (V_E - V_D) \quad (3)$$

Namely, when $V_E > V_D$, a strip is accumulated in a looper. In this case, $\omega s > 0$, and the rotary frame 29 is turned forward. When $V_E > V_D$, the strip 1 is discharged from the looper. In this case, $\omega s > 0$, and the rotary frame 29 is turned backward. In other words, an increase and a decrease in an amount of a strip 1 in the looper can be determined approximately with reference to the direction in which the rotary frame 29 is turned.

$\omega_E$ represents an angular speed of the inlet coil 23, $\omega_D$ an angular speed of the outlet coil 30, $V_{E1}$, $V_{E2}$ denote peripheral speeds of the outermost and innermost layers of the inlet coil 23, $V_{D1}$, $V_{D2}$ peripheral speeds of the outermost and innermost layers of the outlet coil 30, and $V_P$ a speed of the portion of a strip which is moved in the helical turning section 26.

Figure 10:
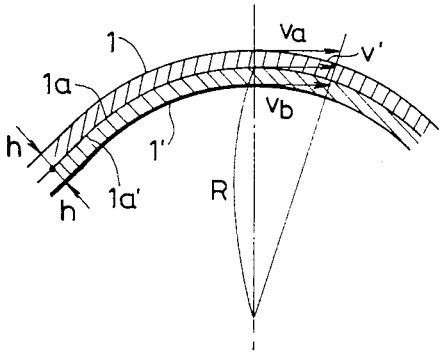
FIG. 10 is a cross sectional view depicting moving speeds of layers of the portions of a strip which form inlet and outlet coils in the looping apparatus according to the present invention.

In order to prevent a slipping phenomenon from occurring between a plurality of wound layers of a strip 1 constituting the inlet and outlet coils 23, 30, it is necessary that the wound layers of the coils 23, 30 are unitarily turned. When the inlet coil 23 and outlet coil 30 are respectively turned, the angular speeds of layers 1, 1' of the strip 1 in each coil 23, 30 become equal as shown in FIG. 10.

As a result, a speed v' of the contact surface 1*a* of the layer 1 and a speed v'' of the contact surface 1*a'* of the layer 1' have the same value, so that the occurrence of a slipping phenomenon between the layers 1, 1' can be prevented.

In order to prevent a strip 1 in the coils from slipping, it is also necessary that an outer diameter of an outer layer of a coil varies with respect to the entry or discharge of a strip 1 into or from this layer thereof. In order to meet the requirement, the support rollers 24, 32 provided on the outer circumferential surfaces of the outer layers of the coils are displaced in the radial direction of the coils in accordance with variations in the diameters of the coils in the manner illustrated in detail in FIGS. 3–6. The diameters of inner layers of the coils also vary since the strip is moved from the inlet coil 23 to the outlet coil 30 through the S-shaped section. Therefore, the support rollers 25, 31 provided on the inner circumferential surfaces of the inner layers of the coils are also displaced in the radial direction of the coils in accordance with variations in the diameters thereof. In order to turn the support rollers 24, 32; 25, 31 with the coils while pressing the former against the latter and maintain the latter in a unitary and tightly wound state, it is necessary that the amounts of displacement of the rollers 24, 32; 25, 31 satisfy the conditions expressed by the following equations:

$$\left.\begin{aligned}
\frac{dR_{E1}}{dt} &= \frac{h}{2\pi} \cdot \frac{V_E}{R_{E1}} \\
\frac{dR_{E2}}{dt} &= \frac{h}{2\pi} \cdot \frac{R_{D2}}{R_{E2} + R_{D2}} \cdot \left(\frac{V_E}{R_{E1}} + \frac{V_D}{R_{D1}}\right) \\
\frac{dR_{D1}}{dt} &= \frac{-h}{2\pi} \cdot \frac{V_D}{R_{D1}} \\
\frac{dR_{D2}}{dt} &= \frac{-h}{2\pi} \cdot \frac{R_{E2}}{R_{E2} + R_{D2}} \cdot \left(\frac{V_E}{R_{E1}} + \frac{V_D}{R_{D1}}\right)
\end{aligned}\right\} \quad (4)$$

The above described embodiment is provided with both the outer support rollers 24, 32 and inner support rollers 25, 31 to unitarily turn the coils while maintaining the coils in a tightly wound state. Even when the inner support rollers 25, 31 alone are employed for the coils 23, 30 to vary the positions of the rollers in accordance with variations in the inner diameters of the coils and thereby bring the rollers 25, 31 into pressing engagement with the inner circumferential surfaces of the coils 23, 30, the coils can also be maintained in a tightly wound state.

The inner support rollers 25, 31 and outer support rollers 24, 32 are rotated by motors 96, 43, respectively, for the purpose of obtaining the auxiliary power for enabling the portions of the strip 1, forming the coils 23, 30 to wind or pay out the strip.

As apparent from the equations (4), the outer radius $R_{E1}$ of the outermost layer of the inlet coil 23 and the inner radius $R_{E2}$ of the innermost layer thereof, which are shown in FIG. 9, increase constantly irrespective of increase and decrease in an amount of a looped strip. On the other hand, the outer diameter $R_{D1}$ of the outermost layer of the outlet coil 30 and the inner diameter $R_{D2}$ of the innermost layer thereof constantly decrease irrespective of increase and decrease in an amount of a looped strip. Consequently an outer diameter of an outer layer of the inlet coil 23 increases at all times since the strip, constantly moves toward the same layer. A radius of an inner layer, from which the strip is constantly payed out into the S-shaped section, constituting the helical turning section 26, of the coil 23 requires to be increased in accordance with an amount of decrease in the same radius. An outer diameter of an outer layer of the outlet coil 30 continues to decrease since the strip is constantly payed out therefrom. An inner diameter of an inner layer, which receives the supply of the strip from the inlet coil 23, of the outlet coil 30 constantly decreases.

Figure 12:
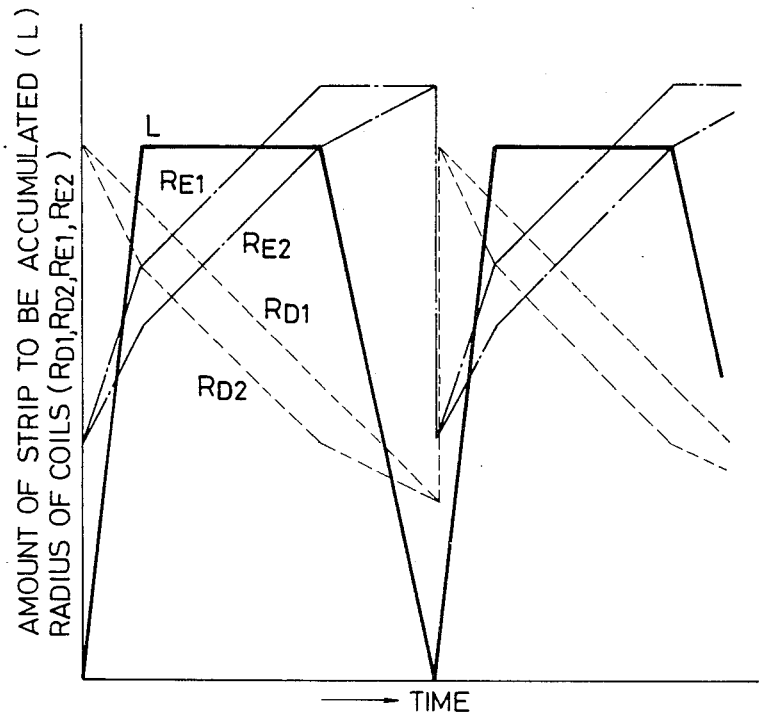
FIG. 12 is a graph showing the operational condition of the looping apparatus according to the present invention.

Therefore, it is necessary that, when an outer radius $R_{E1}$ of the outermost layer of the inlet coil 23 in the looping apparatus reaches a certain level, the portion moving at a speed $V_E$ of the strip which is entering the inlet coil be stopped, to pay out the whole of the portion of the strip, which is in the looper, and that, when the portion of the strip has finished being payed out from the looper, the radii $R_{E1}$, $R_{E2}$, $R_{D1}$, $R_{D2}$ of the coils be set to the same levels as in an initial stage of the looping operation, i.e. reset. Namely, the inlet coil 23 and outlet coil 30 repeat their respective operational cycles, in which the outer and inner radii $R_{E1}$, $R_{E2}$ of the former and the outer and inner radii $R_{D1}$, $R_{D2}$ of the latter vary in accordance with a one-dot-chain line and a broken line, respectively, which are shown in FIG. 12.

In order to reset the radii of the coils, the motors 52, 69 are rotated to turn the gears 48, 65 counter-clockwise and thereby move the outer and inner pivotal members 47, 64 in the direction of broken lines shown in FIG. 6. Consequently, the arm 44 is turned clockwise through the gear 45 to move the outer support roller 24 to an initial position 24*a* shown by a one-dot-chain line, and thereby complete the resetting operation. Similarly, the arm 61 is turned counter-clockwise through the gear 62 to move the inner support roller 25 to an initial position 25*a* and thereby complete the resetting operation.

In order to continuously operate a machine on the outlet side of the looper even during the resetting of the radii $R_{E1}$, $R_{E2}$, $R_{D1}$, $R_{D2}$ of the above-mentioned coils, it is necessary that a means for accumulating on the outlet side of the looper a strip of such a length that corresponds to the length of the time for resetting these radii be provided. The resetting time referred to above is about two seconds. For example, when a speed of the portion of a strip which is on the side of the outlet is 300 m/min, an amount of strip required to be accumulated during such a resetting operation is around $300/60\times 2=10$ m. Accordingly, something like is a dancer roll of a simple construction will work sufficiently as a strip-accumulating means.

A method of controlling the rotation of the rotary frame 29 in the looping apparatus will now be described. A speed $V_P$ of the portion of a strip which passes the central portion of the rotary frame 29 can be expressed by the following equation:

$$V_p = \frac{R_{E2}\cdot R_{D2}}{R_{E2}+R_{D2}}\left(\frac{V_E}{R_{E1}}+\frac{V_D}{R_{D1}}\right) \tag{5}$$

In a first method of controlling a rotational speed of the rotary frame 29, developed in view of the fact that the inlet and outlet coils 23, 30 are maintained in a tightly-wound state by the inner support rollers 25, 31 or outer support rollers 24, 32, a predetermined torque is constantly applied in one direction to the the rotary frame 29 by the motor 27, and the portion of a strip which is on the rotary frame 29 is thereby maintained at predetermined tension at all times. Thus, the rotary frame 29 can be moved to a position, which is determined by the rotation of the inlet and outlet coils 23, 30.

Figure 11:
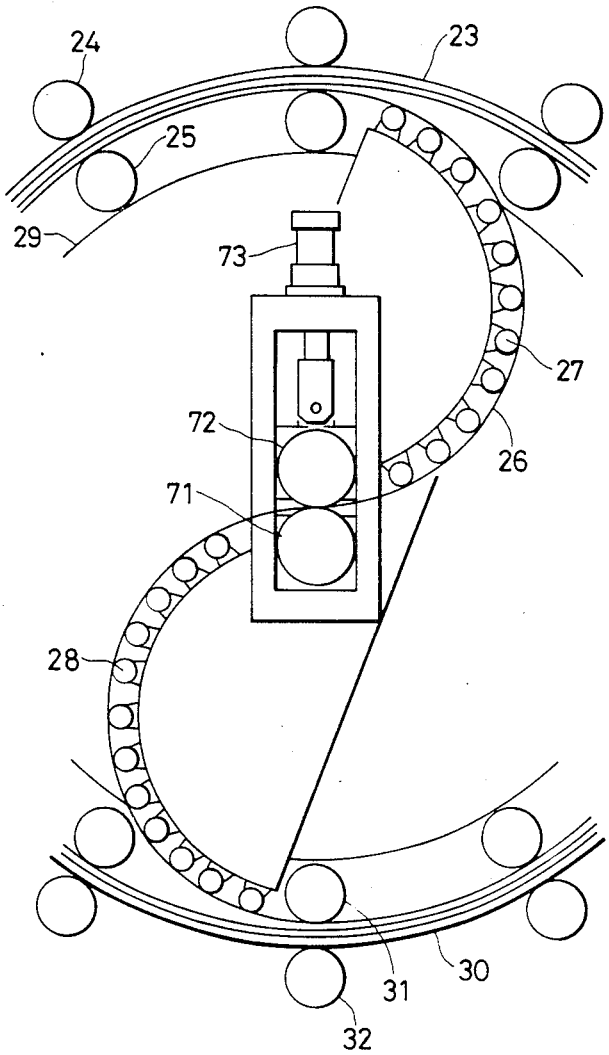
FIG. 11 is a fragmentary sectional view of another example of an S-shaped section of the looping apparatus according to the present invention.

In a second method of controlling a rotational speed of the rotary frame 29, a speed of pinch rollers 71, 72 provided in the rotary frame 29 as shown in FIG. 11 is controlled to a level expressed by the equation (5), and a rotational speed of the rotary frame 29 to a level expressed by the equation (2). During this control operation, a rotational speed of the rotary frame is preferably reduced to a slight extent to apply the tensile force to the strip 1 in such a manner that the strip 1 can smoothly pass the helical turning section 26.

The effect of the helical turning section 26 is as follows:

In the helical turning section 26, the strip 1 advances smoothly without being deformed and unnaturally strained since the circumferential surfaces of the imaginary cones 34, 35 shown in FIG. 8 can be developed into a plane. In order to move a strip 1 from the inlet coil 23 to the outlet coil 30, it is necessary to incline the helical turning section 26 at an angle $\theta$ determined in accordance with the following equation:

$$\theta = \tan^{-1}\frac{H}{D} \tag{6}$$

Inclining the helical turning section 26 at the angle $\theta$ can be easily accomplished by maintaining the strip 1 in a slightly tensed state. In equation (6), the letter D denotes a diameter of the looper, $\theta$ an angle of inclination of the helically turning section, and H the height of descent of the helically turning section. In a spiral looper of a conventional system, the inclination angle $\theta$ is restricted to not more than 15°. Accordingly, when a strip 1 of a larger width is looped in such an apparatus, H necessarily becomes large thereby making it necessary to increase the diameter D of the looper. When a looper having a helical turning section 26 is employed, the inclination angle $\theta$ can be set easily to as large as 45° even if the width of a strip 1 to be looped is large thereby enabling the formation of a compact looping apparatus.

According to the present invention, an apparatus for looping belt-like materials is provided which prevents slipping from occurring between layers of a coil wound strip while the strip is moved, and prevents damaging or spoiling of the quality of the surfaces of the strip.

We claim:

1. An apparatus for looping belt-like materials, the apparatus comprising first and second looping means for winding a moving belt-like material helically into first and second coils, said first and second looping means being arranged so as to have a common substantially horizontally disposed axis, means for drawing out a portion of said belt-like material from an innermost portion of said first coil to an innermost portion of said second coil, a plurality of first support rollers annularly arranged along an inner circumference of said first coil, a plurality of second support rollers annularly arranged around an inner circumference of said second coil, a rotary frame supporting said drawing out means and said first and second support rollers, said rotary frame being rotatable on the same axis as the first and second coils, driving means for driving said rotary frame, and means for displacing said first support rollers radially outwardly and said second support rollers radially inwardly at all times so as not to change the radial position of the belt-like material in said first and second coil until the belt-like material is drawn out from said respective first and second coils, whereby said first and second coils respectively rotate as a unitary body without any slipping of the belt-like material in said first and second coils.

2. An apparatus for looping belt-like materials according to claim 1, wherein said drawing out means includes a plurality of small-diameter rollers over which the belt-like material moves, said small diameter rollers being arranged on a predetermined curved surface defined by two adjacent imaginary cones or cylinders having parallel axes arranged at an acute angle to the axes of the first and second coils, at least two small-diameter rollers are arranged on a plane of the same height on the predetermined curved surface, said small diameter rollers are rotatable in the same direction in which said belt-like material is drawn out, whereby a displacement of the belt-like material from the drawn out direction in said drawing out means is prevented.

3. An apparatus for looping belt-like materials according to claim 1, wherein said driving means applies a predetermined torque on said rotary frame so that a predetermined tension is applied to said belt-like material through said drawing out means.

4. A looping apparatus for accumulating a moving strip material in the form of an inlet spiral coil and an outlet spiral coil rotating on a common horizontal axis, the moving strip material being fed to an outermost layer of the inlet spiral coil, drawn out from the innermost layer thereof, fed to the innermost layer of the outlet spiral coil and discharged from the outermost layer thereof, the apparatus comprising a plurality of first support rollers arranged along an inner circumference of the inlet spiral coil;

a plurality of second support rollers arranged along an inner circumference of the outlet spiral coil;

a rotary frame supporting said first and second support rollers and rotatable on the same axis of the inlet and outlet spiral coils;

a plurality of small diameter free rollers for helically turning the moving strip material from the innermost layer of the inlet spiral coil to the innermost layer of the outlet spiral coil supported by said rotary frame, said small diameter rollers are arranged on a predetermined curved surface defined by two adjacent imaginary cylinders, said cylinders having parallely disposed axes arranged at an acute angle to the axis of said rotary frame, at least two small-diameter free rollers are arranged on a plane of the same height on the predetermined curved surface, said small diameter free rollers are rotatable in an advancing direction of the moving strip material;

a motor means for driving said rotary frame and applying a predetermed torque to the rotary frame so that a predetermined tension is applied to the moving strip material through said small diameter free rollers; and a position regulating means for said first and second support rollers, said position regulating means being adapted to regulate the position of said first and second support rollers so as not to change the radial position in the inlet and outlet spiral coils until the layers are drawn out of the respective inlet and outlet coils, whereby the inlet and outlet spiral coils respectively rotate as a unitary body without any slipping of the layers in the inlet and outlet spiral coils.

* * * * *